US008376598B2

(12) United States Patent
Kondo et al.

(10) Patent No.: US 8,376,598 B2
(45) Date of Patent: Feb. 19, 2013

(54) LIGHT SOURCE UNIT AND VEHICULAR LAMP

(75) Inventors: Toshiyuki Kondo, Tokyo (JP); Daisuke Uchida, Tokyo (JP); Yoshifumi Kawaguchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 673 days.

(21) Appl. No.: 12/178,214

(22) Filed: Jul. 23, 2008

(65) Prior Publication Data

US 2009/0027912 A1 Jan. 29, 2009

(30) Foreign Application Priority Data

Jul. 27, 2007 (JP) ..... 2007-196111

(51) Int. Cl.
*F21V 7/00* (2006.01)

(52) U.S. Cl. ..... 362/516; 362/509; 362/538; 362/539; 362/545

(58) Field of Classification Search ..... 362/459–549
See application file for complete search history.

(56) References Cited

U.S. PATENT DOCUMENTS

| | | | | |
|---|---|---|---|---|
| 6,948,836 | B2 | 9/2005 | Ishida et al. | |
| 7,153,009 | B2 | 12/2006 | Tatsukawa et al. | |
| 2001/0019483 | A1 * | 9/2001 | Takada | 362/517 |
| 2004/0252517 | A1 * | 12/2004 | Ishida et al. | 362/465 |
| 2005/0207162 | A1 * | 9/2005 | Komatsu | 362/296 |
| 2006/0209552 | A1 * | 9/2006 | Okada et al. | 362/509 |
| 2006/0239021 | A1 * | 10/2006 | Inaba | 362/538 |

FOREIGN PATENT DOCUMENTS

| | | |
|---|---|---|
| JP | 2003317513 | 11/2003 |
| JP | 2004247151 | 9/2004 |

* cited by examiner

*Primary Examiner* — William Carter
(74) *Attorney, Agent, or Firm* — Kenealy Vaidya LLP

(57) ABSTRACT

The disclosed subject matter provides a reflecting cover above and between a light-emitting chip and a projection lens. The diffused light from the light-emitting chip is led toward the projection lens via the reflecting cover such that it transmits through the projection lens at a certain angle. This makes it possible to increase the amount of controllable light, and to improve the amount of light beams radiated from the lamp, thereby realizing a brighter lamp and an improved light distribution shape.

8 Claims, 5 Drawing Sheets

LIGHT SOURCE UNIT AND VEHICULAR LAMP

This application claims the priority benefit under 35 U.S.C. §119 of Japanese Patent Application No. 2007-196111 filed on Jul. 27, 2007, which is hereby incorporated in its entirety by reference.

BACKGROUND

1. Technical Field

The disclosed subject matter relates to a vehicular lamp, and more particularly to a light source unit contained in a vehicular lamp for the purpose of illumination in certain lighting devices, such as headlights, spot lights, traffic lights, signal lights, fog lights, etc.

2. Description of the Related Art

FIGS. 10 and 11 show examples of conventional vehicular lamps. First, a vehicular lamp 90 shown in FIG. 10 comprises a reflecting mirror 91 that is a spheroid type and configured as an upper half. An LED light-emitting element 92 or light-emitting source is attached at a first focus f1 of the reflecting mirror 91 such that the central axis of light emission is directed upward. A projection lens 93 is provided which has a focus in the vicinity of a second focus f2 of the reflecting mirror 91.

In this case, a base 94 is used to mount the LED light-emitting element 92 at an appropriate position relative to the reflecting mirror 91. The base 94 extends in the direction of the projection lens 93 and is located in the vicinity of the second focus f2. Therefore, the light emitted from the LED light-emitting element 92 forms the second focus in the vicinity of the tip 94*a* of the base 94, that is, in the vicinity of the focus of the projection lens 93.

The sectional shape of the light focused on the second focus may be formed in a semicircle in the first quarter by the tip 94*a* of the base 94. In this case, the projection lens 93 expands and inverts the above-described shape and projects the inverted shape in the direction of illumination. Thus, the inverted shape is turned into a semicircle in the last quarter, which contains little or no upward light and can provide a distribution characteristic that does not dazzle oncoming vehicles.

A vehicular lamp 100 shown in FIG. 11 comprises a plurality of semiconductor light-emitting elements 102(*a*-*e*) arranged substantially in line such that one side such as a lower side is aligned with a previously set straight line X. It also comprises a lens 104 having an optical center on the previously set straight line X. The lens receives the light emitted from the semiconductor light-emitting elements 102 (*a*-*e*) and projects the combined light in the direction of illumination.

The vehicular lamp 100 is basically required to form a light distribution pattern having an extent in the horizontal direction. Accordingly, the semiconductor light-emitting elements 102(*a*-*e*) are aligned on the basis of the horizontal straight line X. A shield material 112 may be interposed between the semiconductor light-emitting elements 102(*a*-*e*) and the lens 104 to shield the upward light that dazzles oncoming vehicles.

[Patent Document 1] JP 2003-317513A

[Patent Document 2] JP 2004-247151A

In the configuration including the reflecting mirror 91 of the spheroid type provided to cover the LED light-emitting element 92 attached to project light upward (Patent Document 1), the light from the LED light-emitting element 92 located on the first focus is again focused on the second focus f2. The sectional shape of the light focused on the second focus f2 is projected to the front through the projection lens 93. Accordingly, the depth of the vehicular lamp is relatively deep and restrictions exist on the position at which the lamp can be attached which results in problems in terms of design flexibility, weight of the vehicle, etc.

In the system including the semiconductor light-emitting elements 102 arranged in line to form a light source which is analogous to the distribution characteristic, and which is projected through the lens 104, the depth can be relatively smaller. In this case, however, the light emitted from the semiconductor light-emitting elements 102 is diffused. Accordingly, the light that can be led into the lens 104 is only a partial portion of the total light. A number of high-power semiconductor light-emitting elements 102 may therefore be required to ensure a desired brightness. Thus, the full utilization of the light beams is low, which results in efficiency and other problems.

SUMMARY

According to an aspect of the disclosed subject matter, a light source unit can include a vehicular lamp configured to form a light distribution pattern having a horizontal cut-off line on an upper end. The vehicular lamp can include a plurality of lamp units operative to emit light for formation of the horizontal cut-off line. The lamp units each include a substantially rectangular, light-emitting chip. The light-emitting chip includes a light-emitting chip composed of a semiconductor light-emitting element arranged facing front with one side extending in the horizontal direction. A projection lens is provided at the front of the light-emitting chip to invert the image of the light-emitting chip and project the inverted image to the front of the lamp. A reflecting cover linearly connecting the light-emitting chip to the projection lens is provided above the light-emitting chip.

In accordance with another aspect of the disclosed subject matter, the light source unit can include a reflecting cover linearly or substantially linearly connecting the light-emitting chip to the projection lens provided above the light-emitting chip. In this case, it is possible to improve the utilization of light beams even with the identical light-emitting chip, thereby realizing a brighter vehicular lamp. It is also possible to reduce the number of light-emitting chips used and achieve reduced power consumption. Thus, the effects can be exerted on an improvement in performance and an excellent reduction in cost.

DETAILED DESCRIPTION OF EXEMPLARY EMBODIMENTS

Figure 1:
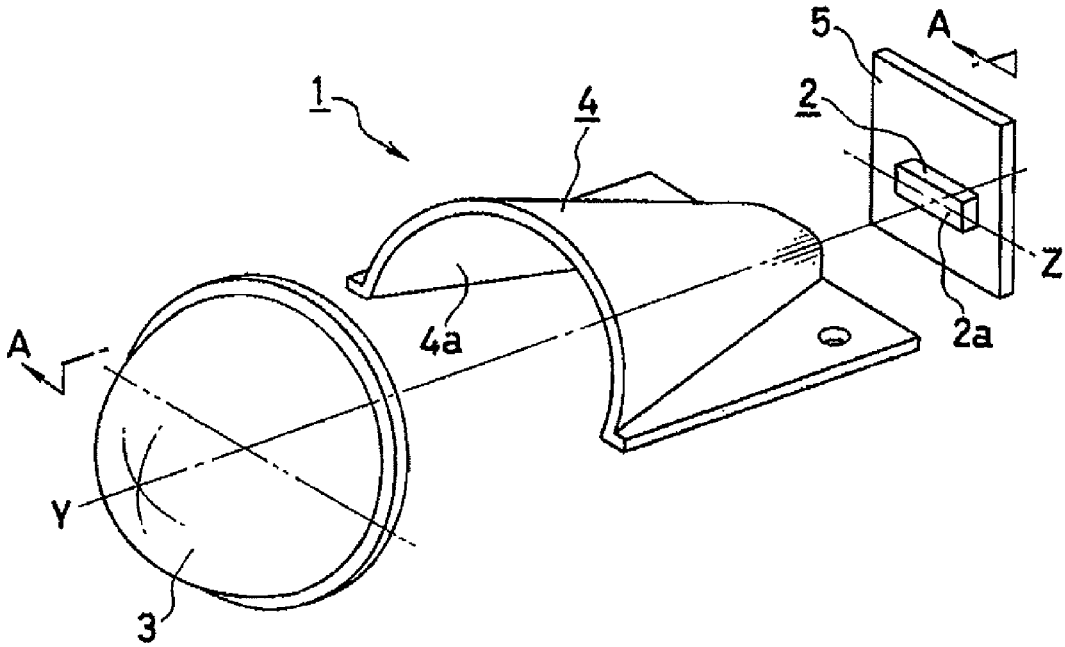
FIG. 1 is a partial perspective view showing a first example of a light source unit made in accordance with principles of the disclosed subject matter.

The disclosed subject matter will now be described in detail based on certain exemplary embodiments shown in the figures. The reference numeral 1 in FIG. 1 denotes a light source unit 1 in a vehicular lamp (hereinafter abbreviated as the "light source unit 1") in a first example according to the disclosed subject matter. The light source unit 1 can include a light-emitting chip 2 formed in a rectangular shape, such as an LED; a projection lens 3 having a focus substantially at (almost or actually coinciding with) the position of the light-emitting chip 2; and a reflecting cover 4 for covering an upper half between the light-emitting chip 2 and the projection lens 3.

The light-emitting chip 2 will now be described. The light-emitting chip 2 can be substantially rectangular including a light-emitting surface 2*a* shaped in a desired rectangle by using a rectangular semiconductor light-emitting element or aligning a plurality of square or rectangular semiconductor light-emitting elements. As a general rule, the light-emitting chip 2 is attached to a vehicle such that the long side of the rectangular light-emitting surface 2*a* is positioned in a horizontal orientation, such that the long side is substantially parallel with a plane containing the road surface upon which the vehicle travels. The lamp can be attached to a base 5 which can also serve as a heat sink such that the light-emitting surface 2*a* normally faces the projection lens 3.

The light-emitting chip 2 may be required in certain jurisdictions to be a white light-emitting chip. In the current state, though, there is no semiconductor light-emitting chip capable of emitting truly white light, and instead, a blue semiconductor light-emitting element may be used and covered with a yellow phosphor to produce color-mixed white. Alternatively, a blue semiconductor light-emitting element may be covered with R (red) and G (green) phosphors which are appropriately mixed. Alternatively, an ultraviolet (UV) or near-UV semiconductor light-emitting element may be covered with R (red), G (green) and B (blue) phosphors of primary colors appropriately mixed to provide a white light.

The light emitted from the light-emitting chip 2 inevitably contains diffused light on transmission through the phosphor. For example, in formation of a terminator, it is difficult to obtain a defined line. In a low-beam distribution, for example, it inevitably contains upward directed light.

In consideration of the above, a reflecting cover 4 can be formed in a shape connecting the outer diameter of the light-emitting chip 2 to the outer diameter of the projection lens 3 with straight lines. Basically, the reflecting cover 4 can have an inner surface 4*a* which is mirror-finished, such as with use of an aluminum-evaporated material.

The reflecting cover 4 is not necessarily formed to cover the entire circumference of the outer diameter of the projection lens 3 but can be formed in a shape basically covering the upper portion of the projection lens 3 about the central axis Y. In this case, the light-emitting chip 2 is attached such that the lower side is aligned with an axis Z which is horizontally orthogonal to the central axis Y of the projection lens 3.

With such a configuration, the light emitted from the light-emitting surface 2*a* of the light-emitting chip 2 is inverted through the projection lens 3 and projected in a direction of illumination. Accordingly, it is projected to the lower portion relative to the central axis Y of the projection lens 3 as downward light, which is suitable for a low-beam distribution.

At the same time, since the light-emitting chip 2 is covered with the phosphor as described above, it also radiates diffused light toward both the upper and lower portions with respect to the central axis Y of the projection lens 3. In the disclosed subject matter, the focal distance of the projection lens 3 is made appropriately and the tilt of the reflecting cover 4 can be adjusted. Thus, when the light emitted upward from the light-emitting chip 2 is reflected at the reflecting cover 4, the greater part is reflected upward.

Accordingly, after light is projected through the projection lens 3 to the front of the vehicle, the light is inverted and almost the entire light is formed as downward light. To further ensure the above operation and reduce the loss in the amount of light after reflection, the inner surface 4*a* of the reflecting cover 4 may be mirror-finished. In this case, it is possible to prevent the reflection from causing diffusion again, from producing upward light, and from causing a loss in the amount of light. Thus, the light source unit 1 can have excellent characteristics in terms of utilization of light beams that are formed.

Figure 3:
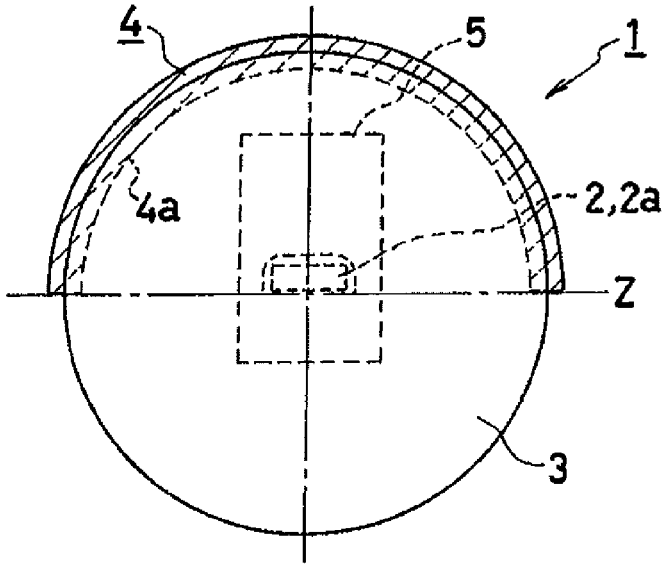
FIG. 3 is an illustrative front view of the arrangement of components in the light source unit of FIG. 1.

FIG. 3 is a front view of the above-described light source unit 1, showing the light-emitting chip 2 having a substantially rectangular, light-emitting surface 2*a* relative to the central axis Y of the projection lens 3. The light-emitting chip 2 can be arranged such that the lower side is aligned with the axis Z which is horizontally orthogonal to the central axis Y of the projection lens 3 and configured such that the lower side is substantially parallel to a plane containing the roadway surface when the lamp is mounted to a vehicle.

Figure 2:
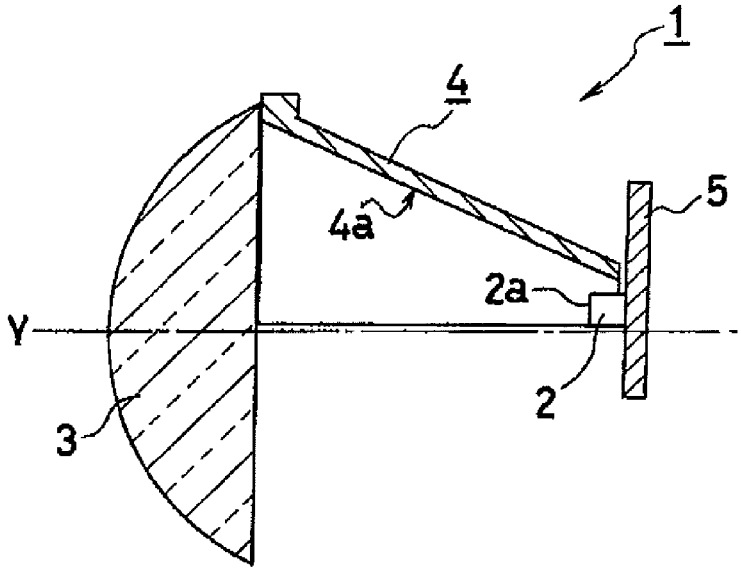
FIG. 2 is a cross-sectional view taken along line A-A in FIG. 1.

In FIG. 2, the reflecting cover 4 is not provided below the central axis Y of the projection lens 3 for at least the following reasons. Namely, if the reflecting cover 4 is provided in this portion, the light emitted from the light-emitting chip 2 and reflected at the reflecting cover 4 is directed downward and enters the projection lens 3, resulting in upward light projected through the projection lens 3 to the front of the vehicle. Accordingly, the arrangement of the reflecting cover 4 is omitted from this portion to prevent the light emitted from the light-emitting chip 2 from reaching the projection lens 3 and causing dazzling light towards oncoming traffic, etc.

Figure 4:
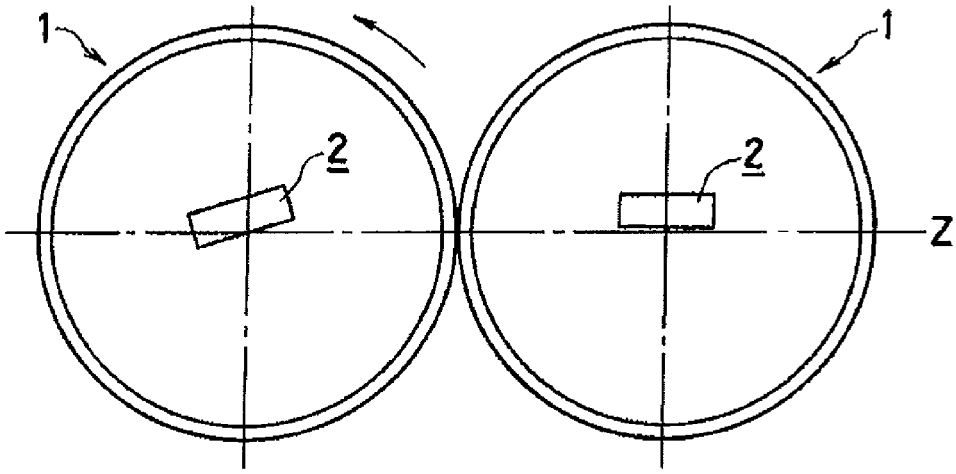
FIG. 4 is an illustrative view of an example of a combination of units for formation of a low-beam distribution for the left-side passage using a light source unit made in accordance with principles of the disclosed subject matter.

FIG. 4 shows another example of the use of a light source unit 1 according to the disclosed subject matter. In the previous example of the use, the light from the light-emitting chip 2 is applied below the central axis Y of the projection lens 3. On actual running, however, for left-side passage, for example, a headlight should be operative to emit appropriate upward light toward the left side to identify a road sign located on the left roadside.

The light source unit 1 of the disclosed subject matter can provide for such a light distribution shape (or alternative light distribution for right side passage countries or territories). As shown in FIG. 4, at least two light source units 1 make a set. One is attached to the body with the light-emitting chip 2 arranged horizontal while another is attached to the body, for example, in a state rotated 15° counterclockwise as seen from the front.

Figure 5:
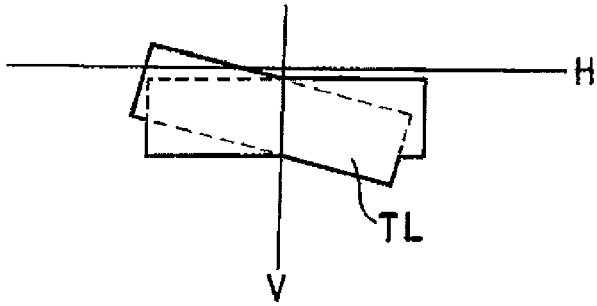
FIG. 5 is an illustrative view showing an example of a shape for a low-beam distribution for left-side passage using the light source unit of FIG. 4.

Such the configuration achieves an irradiation on the road shoulder, for example, with a left-side rise of 15° and an irradiation containing no upward light from the center of the vehicle to the right side as shown in FIG. 5. In this case, the distribution characteristics of lights from both the light source units 1 are synthesized in shape, which is most suitable for a low-beam distribution TL having the so-called elbow. The example herein described is a combination of the rotated and non-rotated light source units 1, though the number of the light source units 1 in either side can be varied freely.

Figure 6:
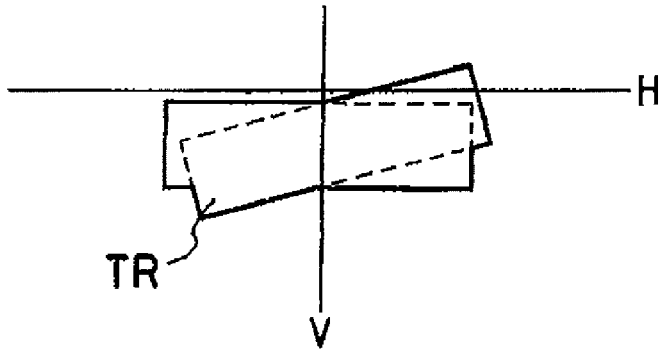
FIG. 6 is an illustrative view showing an example of a shape for a low-beam distribution for right-side passage using the light source unit of FIG. 4.

In accordance with the light source unit 1, the low-beam distribution TL for the left-side passage can be formed by rotating the one light source unit 1 counterclockwise as seen from the front. This may be varied by rotating one of the light source units 1 clockwise to form a light distribution shape for a low-beam distribution TR for the right-side passage as shown in FIG. 6.

Figure 7:
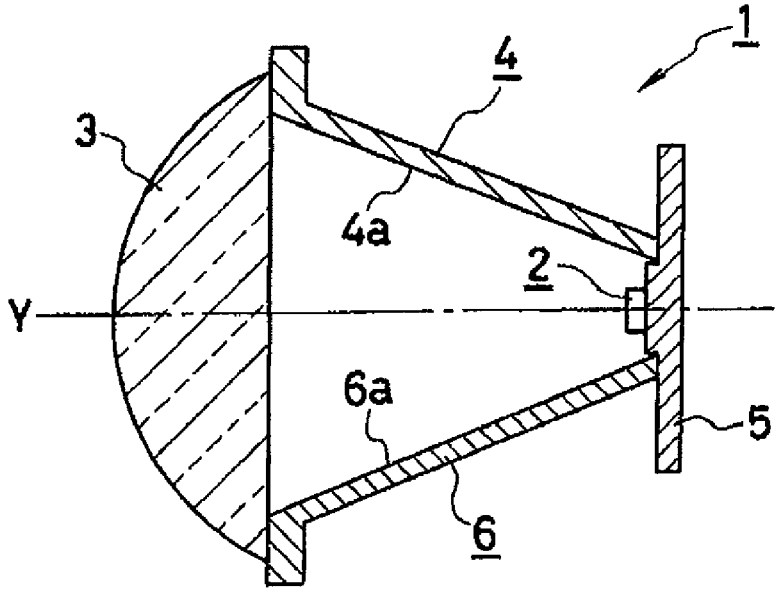
FIG. 7 is a cross-sectional view of a second example showing a configuration when a light source unit made in accordance with principles of the disclosed subject matter is used for high-beam distribution.

FIG. 7 shows a second example. In the first example described above, the reflecting cover 4 is provided only over the upper surfaces of the light-emitting chip 2 and the projection lens 3 and configured to prevent light from traveling upward. To the contrary, in the light source unit 1 of the second example, the light-emitting chip 2 is attached such that the axis Z which is horizontally orthogonal to the central axis Y of the projection lens 3 is substantially coincident with the horizontal central axis of the light-emitting chip 2. The light-emitting chip 2 and the projection lens 3 are also covered from beneath with a lower reflecting cover 6, which is attached as a configuration with an inner surface 6*a* mirror-finished substantially similar to the reflecting cover 4.

With such a configuration, the light emitted downward from the light-emitting chip 2 is received at the lower reflecting cover 6 and reflected toward the projection lens 3. Thus, the utilization of light beams from the light-emitting chip 2 can be improved and a brighter light source unit 1 can be obtained.

Figure 8:
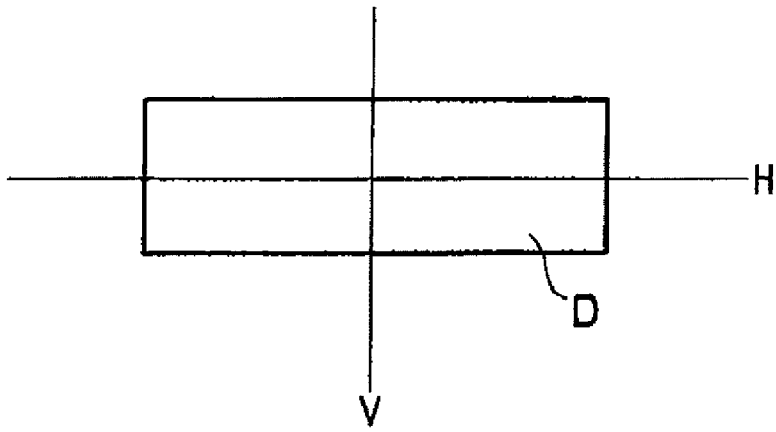
FIG. 8 is an illustrative view showing a shape of a distribution characteristic when a light source unit made in accordance with principles of the disclosed subject matter is used for a high-beam distribution.

When the lower reflecting cover 6 is provided, however, the lower reflecting cover 6 is also operative to reflect. Thus, when the light enters the projection lens 3, projection of upward light through the projection lens 3 is not avoided, as can be understood from the description with respect to the first example of FIG. 1. Accordingly, the lamp of FIG. 7 can be employed as a high-beam light distribution D as shown in FIG. 8, which does not dazzle oncoming vehicles, etc., and is used for distance identification, for example, when running on an expressway in dark conditions and when running in countryside area in dark conditions.

Figure 9:
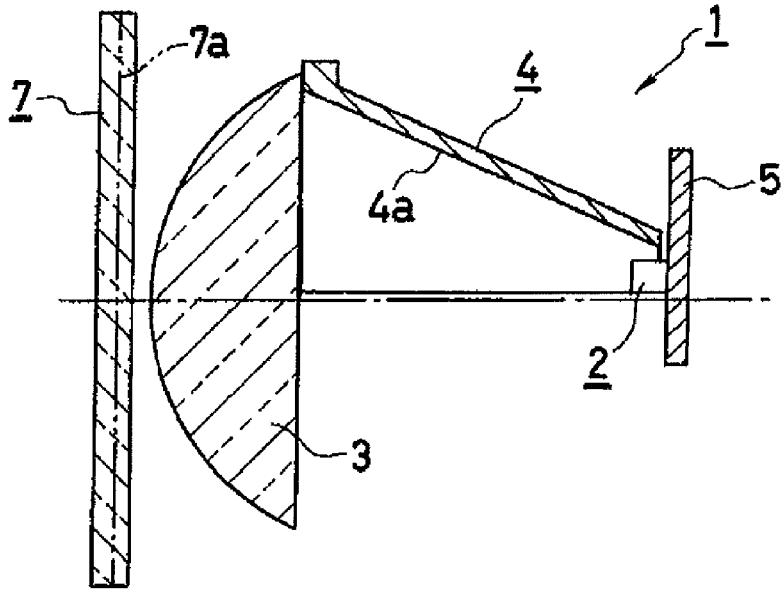
FIG. 9 is a cross-sectional view of a third example of a light source unit made in accordance with principles of the disclosed subject matter.
Figure 10:
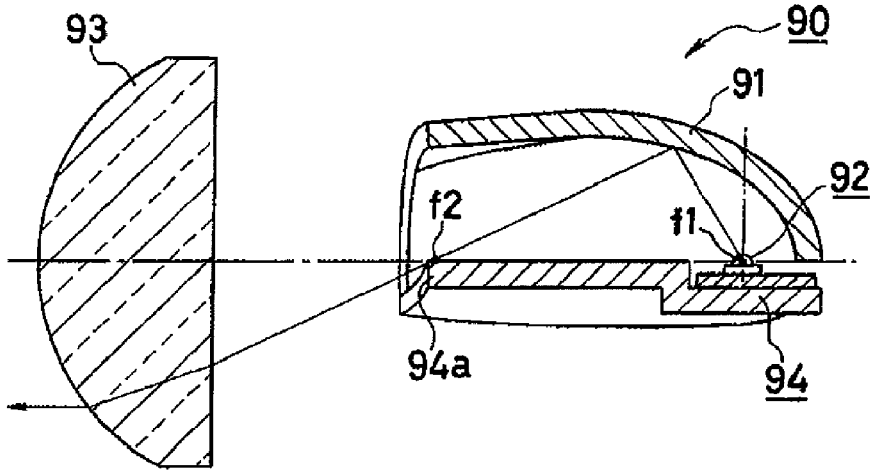
FIG. 10 CONVENTIONAL ART
FIG. 10 is a cross-sectional view showing an example of a conventional art lamp.
Figure 11:
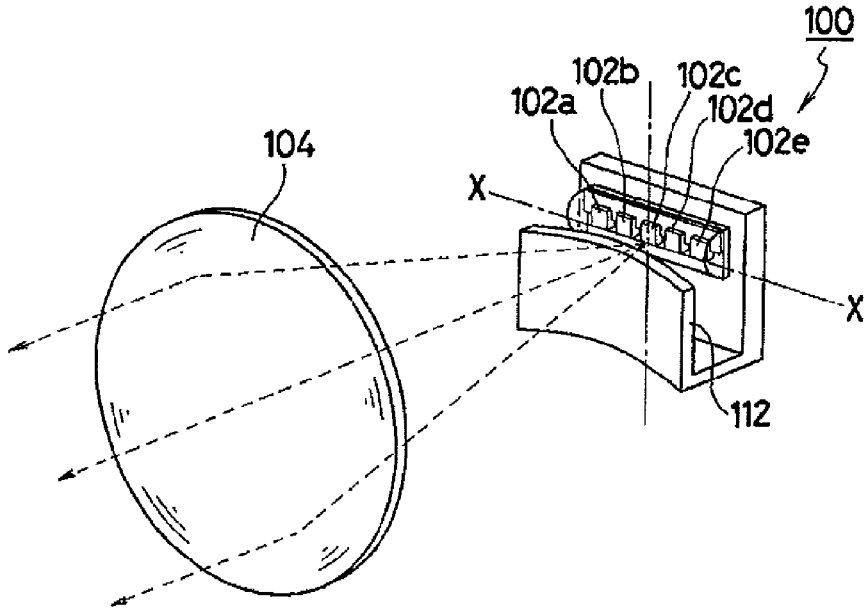
FIG. 11 CONVENTIONAL ART
FIG. 11 is a perspective view showing another example of a conventional art lamp.

FIG. 9 shows a third example of a lamp made in accordance with principles of the disclosed subject matter, which is a light source unit 1 including an auxiliary lens 7 with a vertically or laterally concave or convex lens-cut 7*a* provided in front of the projection lens 3 which can be constructed as shown in the first example shown in FIG. 2. Any of the examples described above can be configured to project light emitted from the light-emitting chip 2 to a vicinity of the focus of the projection lens 3. Accordingly, the image to be projected is inevitably influenced by the size and shape of the light-emitting chip 2.

Therefore, the illumination range and distribution shape may not be obtained appropriately for a vehicle lamp such as a headlight. In such a case, an auxiliary lens 7 with a vertically or laterally concave or convex lens-cut 7*a* may be provided, for example, at the front or rear of the projection lens 3 to obtain a desired distribution shape.

As described above, a reflecting cover 4 can be provided connecting respective outer diameters of the projection lens 3 along straight lines and can be provided in the upper half above both the light-emitting chip 2 and the projection lens 3 which has a focus in the vicinity of the light-emitting chip 2. A plurality of these types of light source units 1 can be combined to configure the lamp as a vehicle lamp such as a headlight, etc., thereby enhancing the flexibility of the combined shape and the flexibility of the design.

The arrangement of the lower reflecting cover may result in a light source unit 1 that is capable of forming a high-beam distribution. Accordingly, light source units 1 with the same configuration including substantially the same components may be combined to produce headlights capable of forming both high- and low-beam light distributions, leading to the production of vehicle lamps such as headlights with smaller types and/or numbers of components.

The light source unit for the low-beam distribution may be rotated counterclockwise and attached to the vehicle. Alternatively, it may be rotated clockwise and attached to the vehicle. This allows the same components to be used in production even when used for the left-side passage or for the right-side passage. Thus, there is provided a production means or configuration that is advantageous in lowering production cost because of a reduced number of components and a reduced number of process steps.

It will be apparent to those skilled in the art that various modifications and variations can be made in the presently disclosed subject matter without departing from the spirit or scope of the presently disclosed subject matter. Thus, it is intended that the presently disclosed subject matter cover modifications and variations provided they come within the scope of the appended claims and their equivalents. All related art references described above are hereby incorporated in their entirety by reference.

What is claimed is:

1. A light source unit for a vehicular lamp configured to form a light distribution pattern having a horizontal cut-off line on an upper end and to emit light in a frontward direction of illumination, the light source unit comprising:

a plurality of lamp units operative to emit light for formation of the horizontal cut-off line, the lamp units each including a substantially rectangular, light-emitting chip, the light-emitting chip including a light-emitting chip composed of a semiconductor light-emitting element arranged facing frontward with one side extending in a horizontal direction;

a hemispherical projection lens provided at a front of the light-emitting chip and configured to invert an image of the light-emitting chip and project the inverted image in the direction of illumination, the projection lens has a central axis and the projection lens has a focus located substantially at a position of the light-emitting chip; and a reflecting cover linearly connecting the light-emitting chip to the projection lens and provided above the light-emitting chip and lies entirely above the central axis of the projection lens, wherein the reflecting cover is formed with an inner surface defined by straight lines connecting the light-emitting chip located on a focus of the projection lens to an outer-most diameter of the projection lens, the reflecting cover being shaped in a narrower extent than a directivity of the light-emitting chip, and the inner surface gradually narrowing in a direction extending from the projection lens to the light-emitting chip, wherein the light-emitting chip is attached to a base such that the light-emitting surface of the light-emitting chip normally faces the projection lens, and wherein the light emitted upwardly from the light-emitting chip is reflected at the reflecting cover and light reflected upward by the reflecting cover is inverted by the hemispherical projection lens such that substantially all of the light emitted by the light-emitting chip is directed downward by the projection lens.

2. The light source unit for a vehicular lamp according to claim 1, wherein the reflecting cover is formed with a surface defined by straight lines connecting the light-emitting chip located on a focus of the projection lens to an outer-most diameter of the projection lens, and the reflecting cover is shaped in a narrower extent than a directivity of the light-emitting chip, wherein the surface of the reflecting cover is provided above and below the light-emitting chip.

3. The light source unit for a vehicular lamp according to claim 2, further comprising:

a lens cut-applied auxiliary lens provided at a front or rear of the projection lens, wherein the lens cut applied to the auxiliary lens is a concave cut or a convex cut in a single direction.

4. The light source unit for a vehicular lamp according to claim 1, wherein at least one lamp unit includes an optical axis and is rotated a certain angle about the optical axis to form an oblique cut-off line rising from the horizontal cut-off line at a certain angle.

5. The light source unit for a vehicular lamp according to claim 4, further comprising:

a lens cut-applied auxiliary lens provided at a front or rear of the projection lens, wherein the lens cut applied to the auxiliary lens is a concave cut or a convex cut in a single direction.

6. The light source unit for a vehicular lamp according to claim 1, further comprising:

a lens cut-applied auxiliary lens provided at a front or rear of the projection lens, wherein the lens cut applied to the auxiliary lens is a concave cut or a convex cut in a single direction.

7. The light source unit for a vehicular lamp according to claim 1, wherein at least one lamp unit includes an optical axis and is rotated a certain angle about the optical axis to form an oblique cut-off line rising from the horizontal cut-off line at a certain angle.

8. The light source unit for a vehicular lamp according to claim 1, further comprising:

a lens cut-applied auxiliary lens provided at a front or rear of the projection lens, wherein the lens cut applied to the auxiliary lens is a concave cut or a convex cut in a single direction.

* * * * *